US007585197B1

(12) United States Patent
Merten

(10) Patent No.: US 7,585,197 B1
(45) Date of Patent: Sep. 8, 2009

(54) CREW OVERBOARD SELF RESCUE DEVICE AND METHOD FOR UNASSISTED CREW OVERBOARD WATERCRAFT REENTRY

(76) Inventor: C. William Merten, 136 E. 76th St., Apt. 8B, New York, NY (US) 10021

( * ) Notice: Subject to any disclaimer, the term of this patent is extended or adjusted under 35 U.S.C. 154(b) by 0 days.

(21) Appl. No.: 11/811,315

(22) Filed: Jun. 8, 2007

Related U.S. Application Data

(63) Continuation-in-part of application No. 11/212,861, filed on Aug. 26, 2005, now abandoned.

(51) Int. Cl.
*B63C 9/00* (2006.01)
*A62B 1/20* (2006.01)
*A63B 27/00* (2006.01)

(52) U.S. Cl. ..... 441/80; 182/190; 182/189; 182/136

(58) Field of Classification Search ..... 441/80, 441/84; 114/362–364; 182/3, 190, 189, 182/136
See application file for complete search history.

(56) References Cited

U.S. PATENT DOCUMENTS

| | | | | | |
|---|---|---|---|---|---|
| 550,343 | A | | 11/1895 | Greener | |
| 1,282,323 | A | | 10/1918 | Trinkle | |
| 2,325,496 | A | * | 7/1943 | Fleming | 472/102 |
| 2,878,981 | A | * | 3/1959 | Guido | 441/80 |
| 4,228,556 | A | | 10/1980 | Searls | |
| 4,313,236 | A | | 2/1982 | Tupper et al. | 9/14 |
| 4,343,056 | A | | 8/1982 | McDonald | 441/84 |
| 4,446,944 | A | * | 5/1984 | Forrest et al. | 182/3 |
| 4,567,961 | A | * | 2/1986 | Schoenfeld | 182/3 |
| 4,599,073 | A | | 7/1986 | Fryer et al. | 441/80 |
| 4,599,074 | A | | 7/1986 | Beckly | 441/80 |
| 4,678,446 | A | | 7/1987 | Dahan | 441/80 |
| 4,747,797 | A | | 5/1988 | Hindle | 441/38 |
| 5,074,236 | A | | 12/1991 | Robertson | 114/362 |
| 5,192,238 | A | | 3/1993 | Brown | 441/84 |
| 5,435,766 | A | | 7/1995 | Epstein | 441/80 |
| 5,540,178 | A | * | 7/1996 | Damron | 114/362 |
| 5,779,511 | A | | 7/1998 | Davidson, Jr. | 441/80 |
| 5,848,667 | A | * | 12/1998 | Davidson | 182/190 |
| 6,093,070 | A | | 7/2000 | Mannes | 441/80 |
| 6,357,551 | B1 | * | 3/2002 | Bogardus, III et al. | 182/196 |
| 6,953,374 | B1 | | 10/2005 | Connolly | 441/80 |

OTHER PUBLICATIONS

Szepessy, Chris, Staying on the Boat and MOB Rescue, Wind Check, May 2005, pp. 24-25, Anne Hannan, Bridgeport, CT.

* cited by examiner

*Primary Examiner*—Lars A Olson
*Assistant Examiner*—Daniel V Venne
(74) *Attorney, Agent, or Firm*—St. Onge Steward Johnston & Reens LLC

(57) ABSTRACT

A crew overboard self rescue device including a tether and an ascension device. The tether has attachment loops for the ascension device disposed along its length. The ascension device includes a flexible strap with attached footholds and an attachment to the tether. The tether is attached between a hard point on a watercraft and a harness worn by the crew. The ascension device is stowed in a container such as a fanny pack worn by the crew. In a crew overboard situation, the crew retrieves the ascension device from the container, attaches the ascension device to one of the attachment loops disposed on the tether, and using the footholds, climbs the ascension device while stabilizing his upper torso by grasping the tether.

22 Claims, 12 Drawing Sheets

CREW OVERBOARD SELF RESCUE DEVICE AND METHOD FOR UNASSISTED CREW OVERBOARD WATERCRAFT REENTRY

CROSS REFERENCE TO RELATED APPLICATIONS

This is a continuation in part of application Ser. No. 11/212,861, Filed 2005 Aug. 26 now abandoned.

FEDERALLY SPONSORED RESEARCH

Not Applicable

SEQUENCE LISTING OR PROGRAM

Not Applicable

BACKGROUND OF THE INVENTION

1. Field of Invention

This invention relates to watercraft safety devices, specifically to crew overboard recovery devices which are used to assist reentry of a crew overboard into a watercraft.

2. Background of the Invention

A serious hazard associated with sailing is that of falling overboard while the boat is under way. Any person who has fallen overboard is referred to as a "crew over board." Situations which are particularly hazardous include working on deck in heavy seas, being hit unexpectedly by a large wake, being hit by the boom, broaching, or being washed overboard by breaking waves in especially stormy weather.

One element of a successful crew overboard rescue is retrieval once the crew overboard has been found. U.S. Pat. No. 6,093,070 to Mannes describes a crane attached to a ship for the lifting of individuals from the water. Unfortunately, the device described in this patent is much too large to be practical on most recreational sailboats. In U.S. Pat. No. 4,599,074, Beckly discloses a more compact boom for crew overboard retrieval. Yet another device employing a detachable boom and sling is described by McDonald in U.S. Pat. No. 4,343,056. A more compact hoisting system is described in U.S. Pat. No. 5,779,511 by Davidson. This system comprises a triangular harness which utilizes two points of attachment to a sailboat and one to a halyard. The harness is placed under the crew overboard and the halyard is hoisted to raise the crew overboard to the level of the deck. A sling with an attachable inflatable buoy and keel is described by Hindle in U.S. Pat. No. 4,747,797. The sling is used as both a flotation aid and device to assist retrieval. Means of hoisting the crew overboard in the sling are not addressed. Yet another example of a crew overboard retrieval device is disclosed by Fryer et al. in U.S. Pat. No. 4,599,073. This retrieval device integrates buoyant material into a lifting sling which is tethered to the boat by a long floating line. A block and tackle attached between the sling and the boom of a sailboat can be used to hoist the crew overboard to a level where he can be swung into the boat. The devices cited above have at least one commonality. They all require at least one person onboard the boat to assist in retrieval of the crew overboard. It is not uncommon for individuals to sail alone without a crew. In such instances, the devices cited above are useless to the single handed sailor in a crew overboard situation.

The single handed sailor will often employ a tether attached on one end to a harness worn by the sailor and attached on the other end to a strong point on the boat such as a pad eye. The tether will prevent a sailor from being separated from the boat in the event that he should go overboard. However, a tether will not prevent an individual from going overboard. A tether which is short enough to do so does not provide freedom of movement sufficient to accomplish the tasks necessary to sail the boat. If a tethered single handed sailor does go overboard, he must then reenter the boat without assistance from others. Given the height of the gunwale above the water, this is at best a difficult task. The crew overboard must first find a way to reach above the gunwale to grasp a cleat, stanchion, or other fixture. He must then pull himself up to the point where he can hook his leg over the gunwale. Then he must use both arms and legs to pull himself inside the boat. In addition, these maneuvers must be performed while the boat is under way and the crew overboard is being dragged through the water. Needless to say, better than average strength and fitness are required to reenter the boat unassisted.

An example of a commercially available device marketed to the single handed sailor for crew overboard use is a boarding ladder. These are flexible, stowable ladders and require attachment at the level of the gunwale or above. The utility of these devices to the single handed crew overboard is limited since it is unlikely that the crew overboard will be able to reach the level of the gunwale to attach a ladder or that ladders attached to the boat prior to going overboard will be sited appropriately.

Trailing line devices are yet another means of assistance targeted at the crew overboard. The simplest manifestation of such a device is a long floating line trailed behind the boat. In theory, the crew overboard swims to the line and then uses it to pull himself to the swim ladder on the back of the boat. To reach the trailing line, the crew overboard must cut his tether, thus separating himself from the boat. In practice, at all but the slowest speeds, the drag on the crew overboard is so great that he will not be able to pull himself up the trailing line. Other examples of trailing line crew overboard assistance are disclosed by Searls in U.S. Pat. No. 4,228,556 and by Brown in U.S. Pat. No. 5,192,238. The system described by Searls employs a trailing line to deploy a life ring and crew overboard pole. Recovery of the crew overboard is not addressed. Brown describes a system which uses a sea anchor and pulley to retract the trailing line and hoist the crew overboard to the level of the gunwale. While overcoming many of the deficiencies of other crew overboard recovery systems, the system described by Brown appears to be complex with the attendant disadvantages of high cost and questionable reliability.

From the foregoing discussion, clearly, there is a need for a crew overboard retrieval system which allows the single handed crew overboard to reenter the boat under his own power.

OBJECTS AND ADVANTAGES

Accordingly, several objects and advantages of my invention are:

(a) to provide a boat reentry system which can be utilized by a crew overboard without the assistance of others;

(b) to provide a boat reentry system whereby a crew overboard can ascend to the level of the gunwale under his own power;

(c) to provide a boat reentry system which is accessible to a crew overboard regardless of the point of egress from the boat;

(d) to provide a boat reentry system which does not require the crew overboard to detach his tether;

(e) to provide a boat reentry system which does not require additional hardware to be mounted on the boat; and (f) to provide a boat reentry system which allows the crew overboard to overcome the drag on himself resulting from the forward motion of the boat through the water.

Further objects and advantages are to provide a boat reentry system which is simple to operate, is light enough to carry on one's person at all times, and is simple and inexpensive to manufacture. Still further objects and advantages of my invention will become apparent from a consideration of the drawings and ensuing description.

SUMMARY

In accordance with the present invention, a crew overboard recovery system comprises a tether and an ascension device which can be attached to a point on the tether between the ends of the tether. The tether has one or more loops attached to its midsection which serve as attachment points for the ascension device. The ascension device comprises a series of stirrups or steps which are attached to one or more flexible straps or lines. The ascension device has a means of attachment at the end opposite the end to which the lowermost stirrup or step is attached. In normal use, one end of the tether is anchored to the boat and the other end is attached to a harness worn by the user. In a crew overboard situation, the crew overboard attaches the ascension device to the highest loop he or she can reach on the tether. The crew overboard then scales the ascension device by climbing the stirrups or steps using leg extension to elevate himself to a level where he can reenter the boat.

DRAWINGS

Figures

DRAWINGS

Reference Numerals

Figure 1:
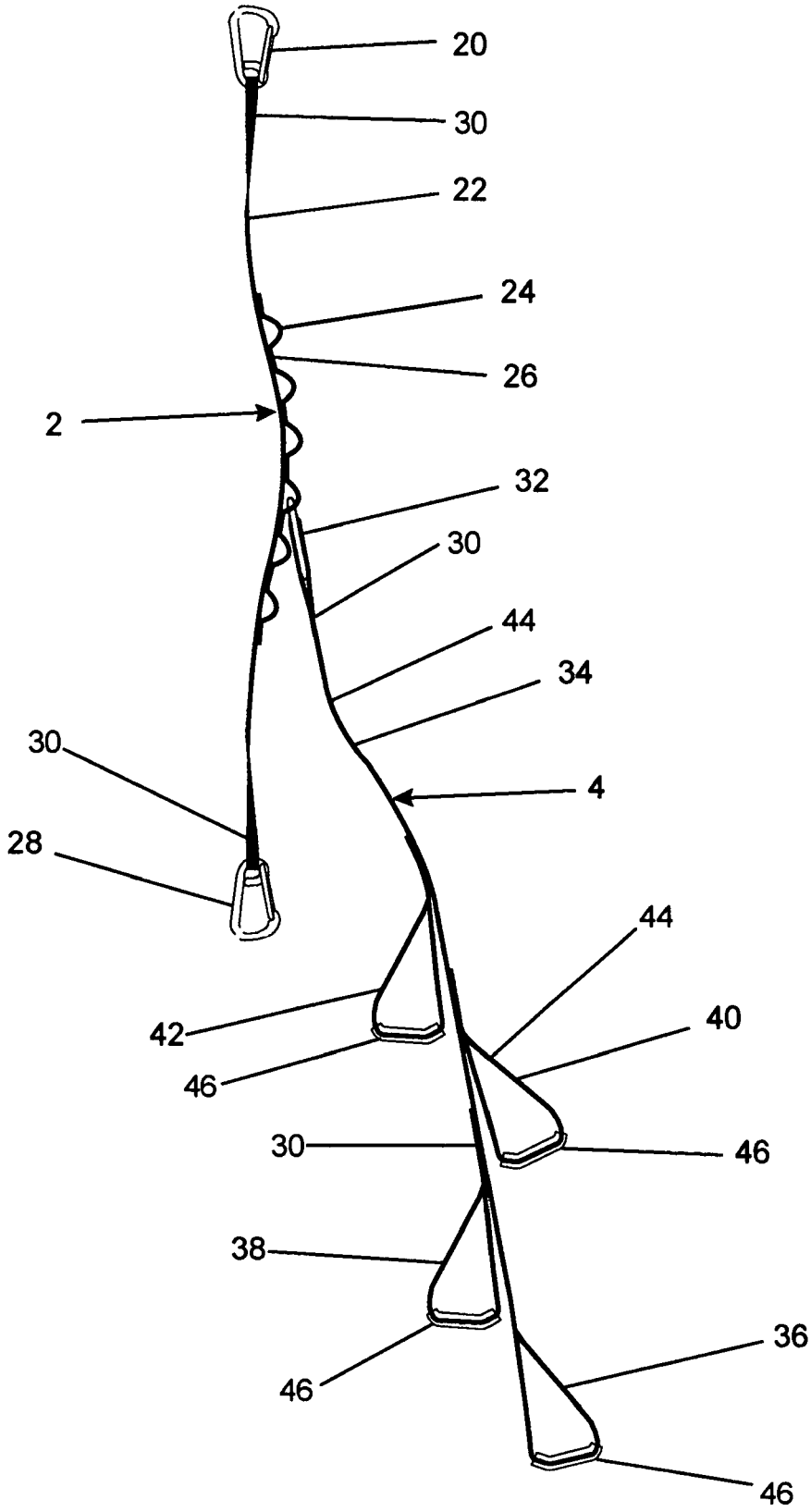
FIG. 1 shows the assembled components of the preferred embodiment of the crew overboard self rescue system.

2 tether
4 ascension device
6 supplemental tether
8 buckle tether
10 adjustable ascension device
12 ladder
20 watercraft attachment device comprising a snap hook
22 tether strap
24 attachment loop
26 attachment loop webbing
28 crew attachment device comprising a snap hook
30 stitching with thread resistant to degradation by ultraviolet light
32 ascension device attachment apparatus comprising a snap hook
34 elongate flexible tensile member
36 lowermost foothold comprising a stirrup comprising strap
38 second foothold comprising a stirrup comprising strap
40 third foothold comprising a stirrup comprising strap
42 uppermost foothold comprising a stirrup comprising strap
44 buoyant material
46 stirrup spreader
48 harness
50 crew
52 means for containment of ascension device
54 means of attachment to crew for means for containment
56 watercraft
58 crew center of gravity
60 gunwale
62 coaming
64 water
66 waterline
68 supplemental watercraft attachment device
70 supplemental tether strap
72 supplemental attachment loop
74 supplemental attachment loop webbing
78 upper elongate flexible tensile member
80 buckle
81 uppermost end of upper elongate flexible tensile member
82 lowermost end of upper elongate flexible tensile member
84 lower elongate flexible tensile member
86 uppermost bitter end
88 watercraft attachment device comprising a snap shackle
90 crew attachment device comprising a carabiner
92 elastic material
94 ladder rung
96 elongate flexible tensile member of ladder
98 cord
100 splice
102 stirrup comprising cord
104 tether comprising cord
106 attachment loops comprising cord
108 elongate flexible tensile member comprising cord

DETAILED DESCRIPTION

FIGS. 1 through 7—Preferred Embodiment

A preferred embodiment of the crew overboard recovery system of the current invention is illustrated in FIGS. 1 through 7.

Figure 2:
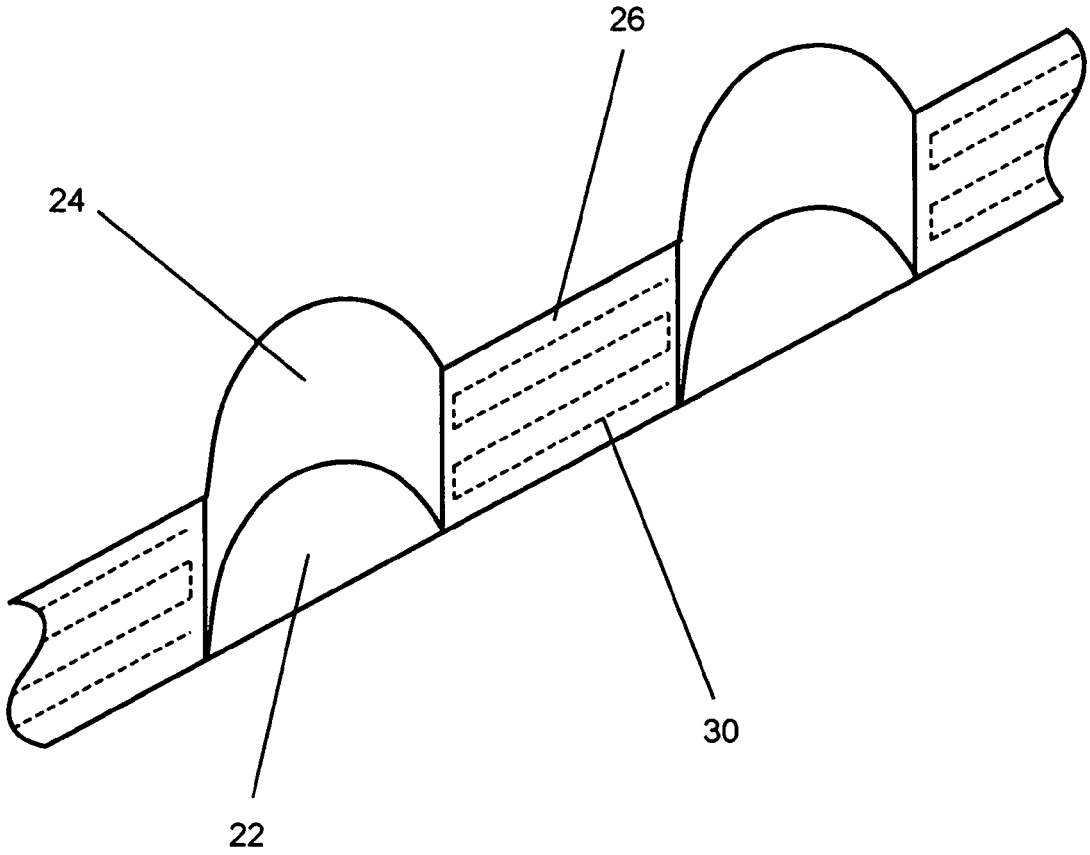
FIG. 2 illustrates the use of thread resistant to degradation by ultraviolet light to secure attachment loops to a tether strap.
Figure 3:
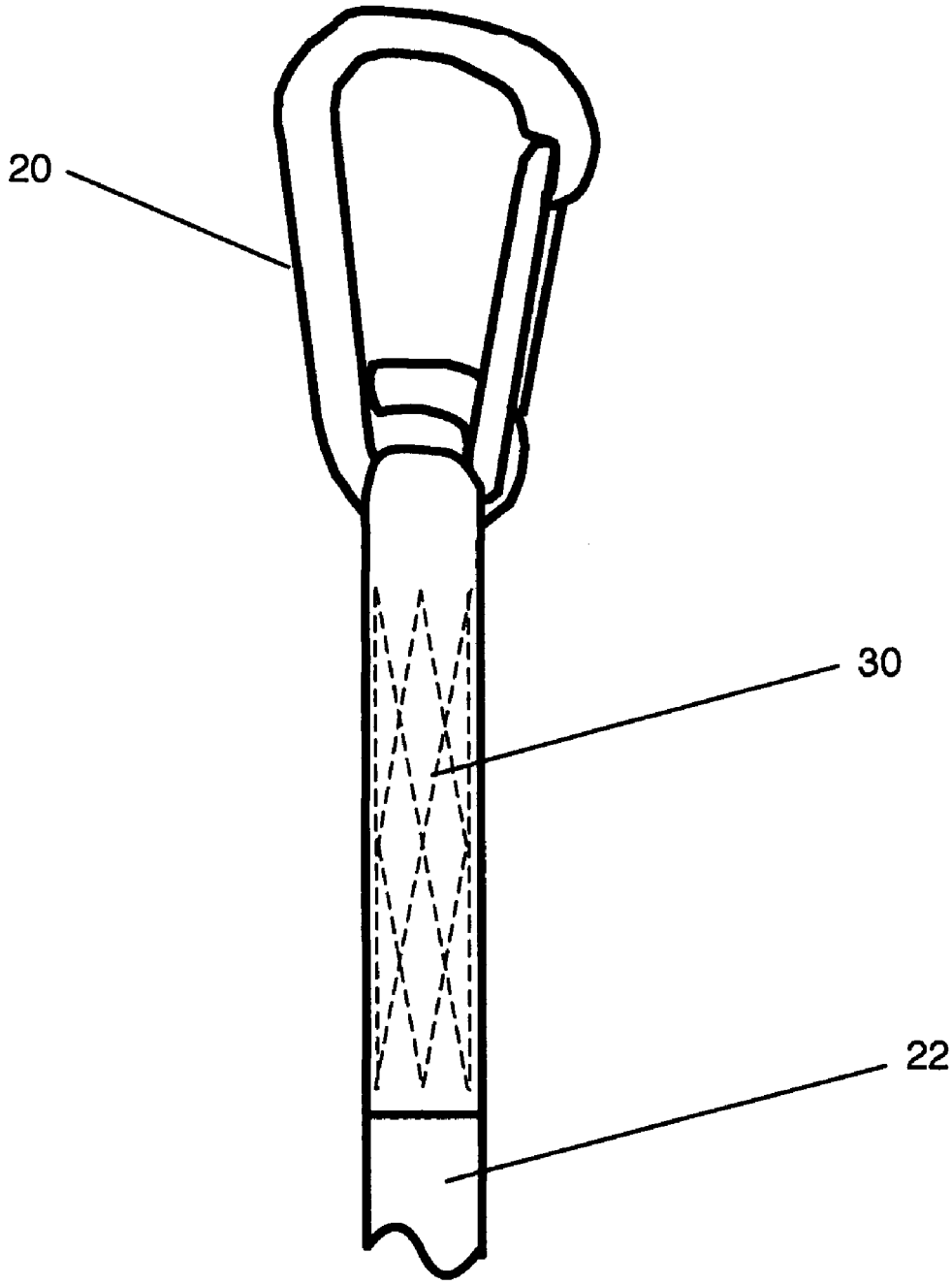
FIG. 3 shows the stitching pattern used to join an attachment device to a tether or an ascension device.
Figure 6:
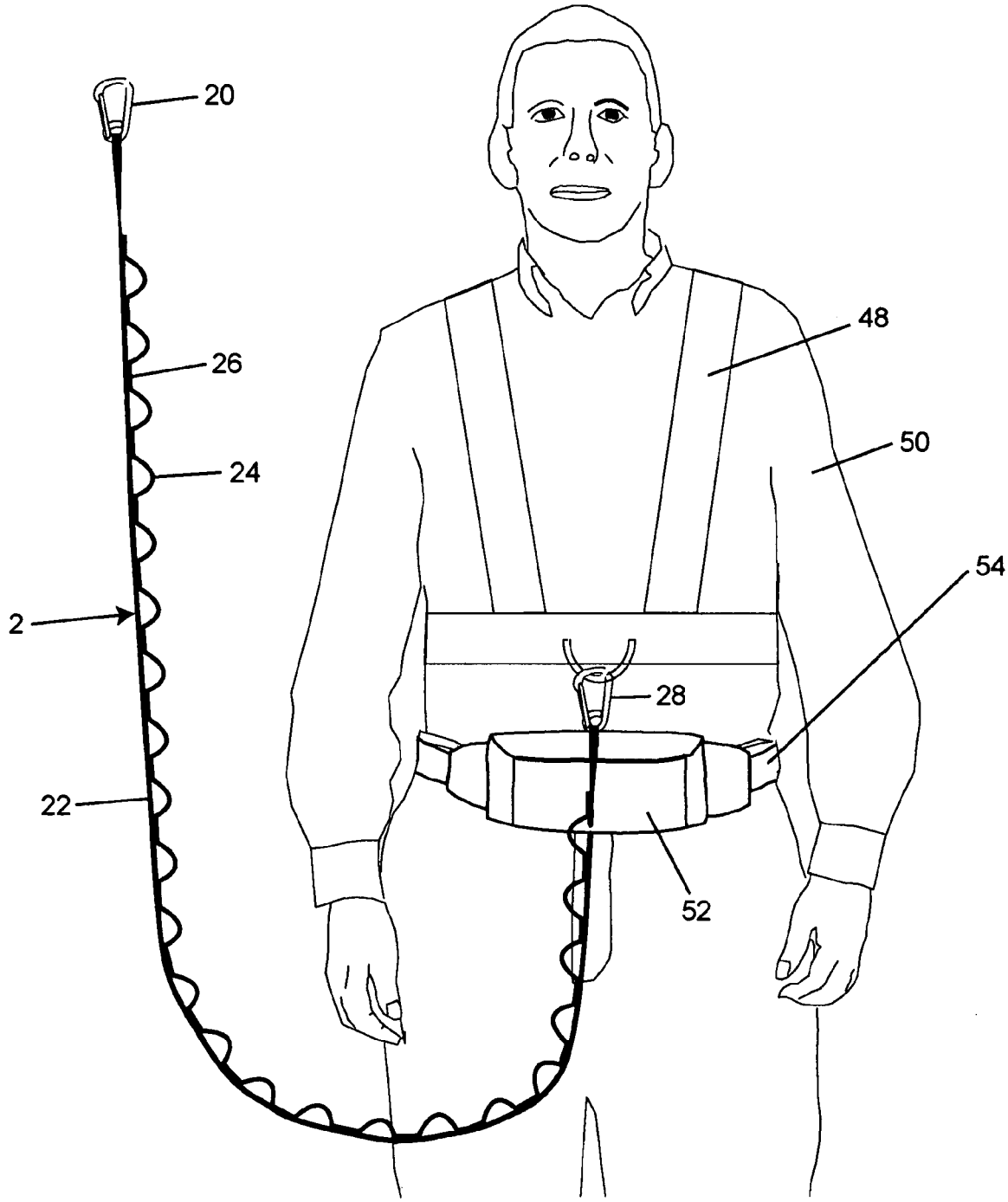
FIG. 6 shows a crew wearing a means of containment for an ascension device.

Referring to FIG. 1, a tether 2 comprises a tether strap 22, a watercraft attachment device 20, attachment loop webbing 26 formed into attachment loops 24, and a crew attachment device 28. The tether 2 is shown with twists present in the same to reveal pertinent details of construction. The tether strap 22 is preferably high strength webbing approximately 2.5 cm in width. An advantage of webbing is the ease with which loops can be formed and secured by stitching. In the preferred embodiment, attachment loops 24 are formed by gathering a length of attachment loop webbing 26. As shown in FIGS. 1 and 2, the attachment loop webbing 26 is secured to the tether strap 22 with stitching between the attachment loops 24, preferably with thread resistant to degradation by ultraviolet light 30. The stitching pattern shown in FIG. 2 is approximately 5 cm in length and provides stitching between the attachment loops 24 of a sufficient length to support the weight of a crew overboard. Of course, the length of the stitching pattern and the distance between attachment loops 24 can be increased or decreased provided the total length of stitching is sufficient to bear the crew's weight. As shown in FIG. 1 and FIG. 6, the placement and extent of the attachment loops 24 along the tether strap 22 may be varied to either conserve material and decrease manufacturing costs or to increase versatility. The tether strap 22 is of sufficient length to provide an acceptable range of motion to a user while on a boat. The typical length of tethers commercially available for marine use is approximately 2 meters. The tether of the preferred embodiment is similar in length. As shown in FIG. 3, the watercraft attachment device 20 is attached to one end of the tether strap 22 by passing the tether strap 22 through a snap hook 20, doubling the tether strap 22 back onto itself and securing with stitching, preferably with thread resistant to degradation by ultraviolet light 30. In the preferred embodiment, the stitching pattern shown in FIG. 3 is approximately 14 cm in length. Details such as the length and number of passes of stitching may be varied, but the length of the stitching must be sufficient to withstand the shock load imposed by the fall of a sailor being arrested by the tether. The watercraft attachment device 20 is a snap hook which provides a detachable means of attachment of the tether 2 to the watercraft. The crew attachment device 28, which is also a snap hook, is situated at the other end of the tether strap 22 and is attached to the tether strap 22 in a manner identical to that for the watercraft attachment device 20.

Figure 4:
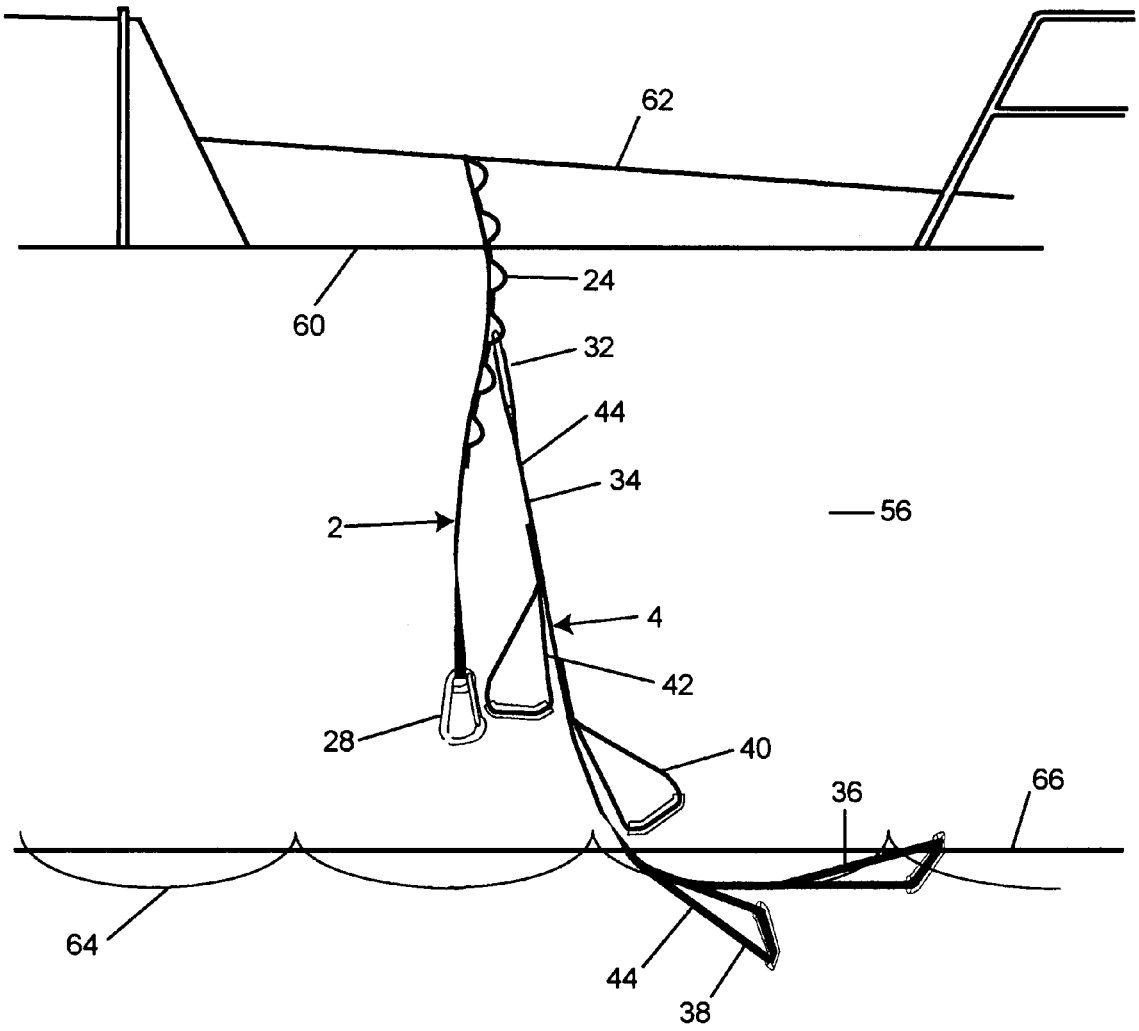
FIG. 4 depicts the use of buoyant material in an ascension device causing the ascension device to float.

Referring again to FIG. 1, an ascension device 4 comprises an ascension device attachment apparatus 32, an elongate flexible tensile member 34, and a plurality of footholds 36, 38, 40, and 42. In the preferred embodiment, the ascension device attachment apparatus 32 is a snap hook, the elongate flexible tensile member 34 is a strap made from high strength webbing, and the plurality of footholds 36, 38, 40, and 42 are stirrups. For the elongate flexible tensile member 34, a length of 185 cm and a width of 2.5 cm have been found to be suitable. The plurality of stirrups 36, 38, 40, 42 are attached successively to the elongate flexible tensile member 34 along its length to form a series of steps which the crew overboard may climb. In the preferred embodiment, the stirrups are also made from high strength webbing approximately 2.5 cm in width. The spacing between stirrups is approximately 30 cm and the length of the open loop perimeter of each stirrup is approximately 60 cm. As shown in FIG. 4, preferably both the ascension device strap 34 and stirrups 36, 38, 40, 42 are made from a buoyant material 44 such as polypropylene. The purpose behind fabrication of the ascension device from buoyant material is to cause the ascension device 4 to float so that it cannot become entangled in a propeller. Preferably, the stirrups are formed by looping webbing onto itself and stitching the overlapped ends to the ascension device strap 34 with thread resistant to degradation by ultraviolet light 30. The length of the overlap and the length of the stitching which secures the overlap to the ascension device strap 34 must be sufficient to support the weight of the crew overboard. The stitching pattern shown in FIG. 3 and having a length of 14 cm has been found to be adequate for this purpose. Stirrup spreaders 46 maintain the stirrups 36, 38, 40, 42 in an open position so that the crew overboard can easily insert his foot into the stirrups 36, 38, 40, 42. Preferably, the stirrup spreader 46 comprises a short length of tubing approximately 15 cm in length. The stirrup webbing is threaded through the tubing to maintain the stirrup 36, 38, 40, 42 in an open configuration. The ascension device attachment apparatus 32 is attached to the elongate flexible tensile member 34 at the end of the elongate flexible tensile member 34 opposite the lowermost stirrup 36. Preferably, the elongate flexible tensile member 34 is threaded through the ascension device attachment apparatus 32, doubled back over onto itself, and secured with stitching of a sufficient length to support the weight of the crew overboard. The stitching pattern shown in FIG. 3 and having a length of 14 cm has been found to be more than adequate. Preferably, the thread used for stitching is resistant to degradation by ultraviolet light 30. In a crew overboard situation, the ascension device attachment apparatus 32 is attached to an attachment loop 24.

Figure 5:
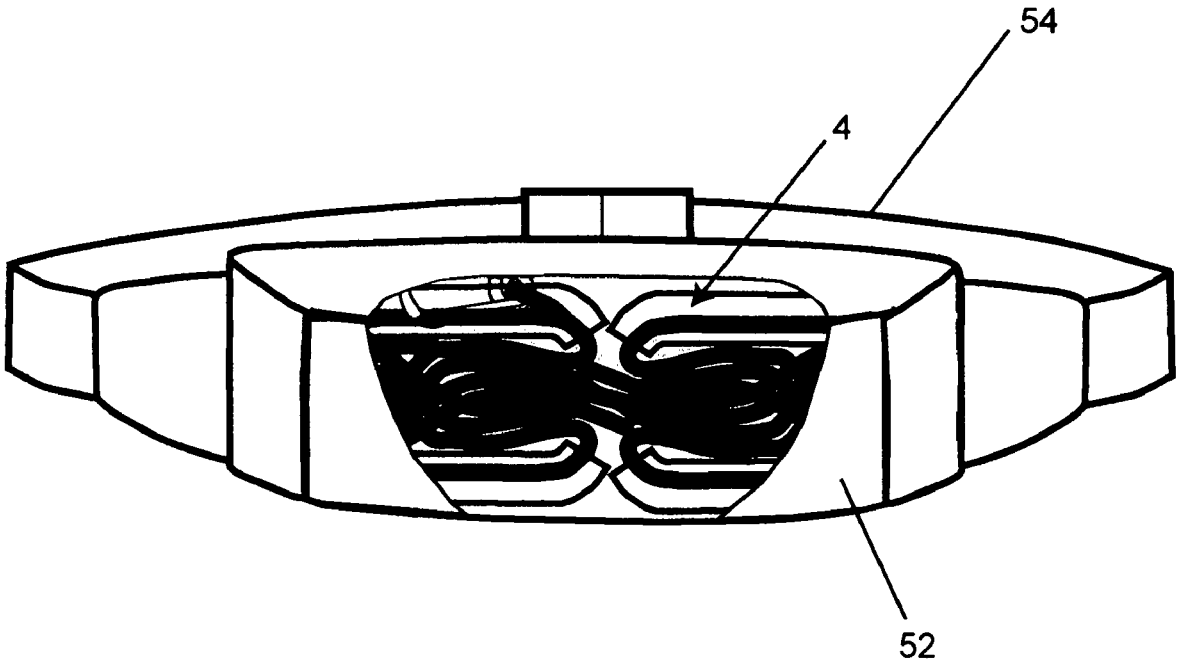
FIG. 5 illustrates the storage of an ascension device in a wearable means of containment.

In situations where use of a tether is desirable, the crew attaches the watercraft attachment device 20 to a hard point on the boat such as a pad eye and the crew attachment device 28 to a harness 48 worn by the crew. In cases where the watercraft attachment device 20 and crew attachment device 28 are identical and the attachment loops 24 are symmetrically disposed with respect to the midpoint of the tether, either attachment device may be attached to the watercraft with the other being attached to the harness. As shown in FIGS. 5 and 6, the ascension device 4 is folded and stored in a means for containment 52 attached to the crew 50 by a means of attachment 54. The means for containment 52 can be a commercially available fanny pack, a pouch secured to the crew's harness, or other means of wearable containment having a means of attachment 54 to the crew. The means for containment 52 can be made of nylon or any other high durability material. Suitable closure systems for the means for containment are zippers or hook and loop fasteners. In the case of a fanny pack, the means of attachment to the crew 54 might be a webbed belt with adjustable girth and a commercially available closure system such as D-rings, a buckle, a snap closure, or a hook and loop fastener such as Velcro®. For the case of a pouch attachable to a harness 48, a hook and loop fastening system might be used to join the pouch to the harness. The specific means for containment 52 and means of attachment 54 are of limited significance so long as the means for containment 52 can be worn by the crew in an accessible location.

Operation

FIG. 7

Figure 7:
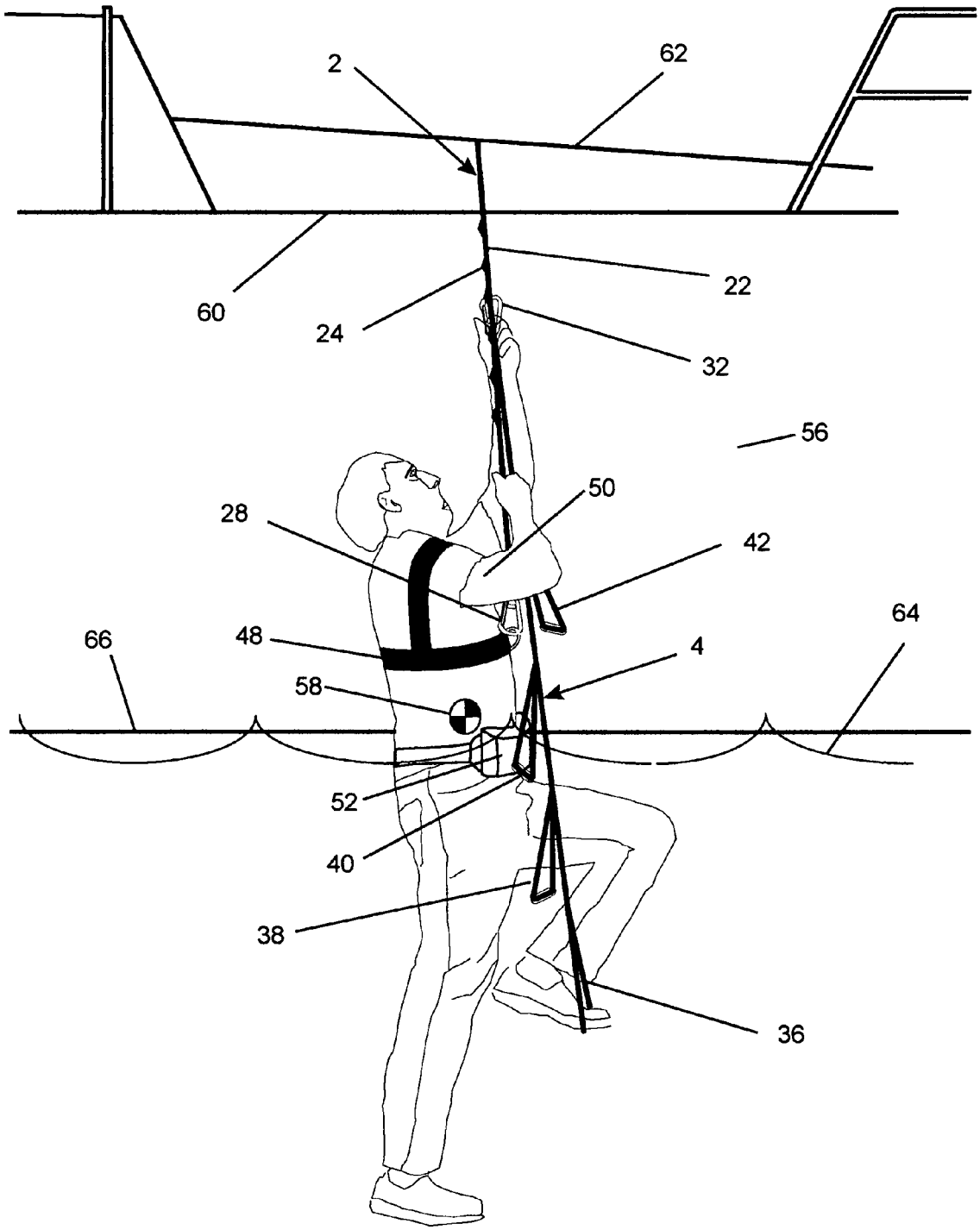
FIG. 7 illustrates use of the crew overboard self rescue system.

In the event that the crew 50 goes overboard, the crew first retrieves the ascension device 4 from its means for containment 52. Referring to FIG. 7, the crew overboard is suspended from the watercraft 56 in the water 64 by his harness 48 and tether 2. The crew overboard attaches the ascension device 4 to the highest tether attachment loop 24 he can reach using the ascension device attachment apparatus 32. Next the crew overboard places one of his feet in the lowermost stirrup 36 or any other convenient stirrup. The crew overboard then climbs the ascension device by extending the leg engaged with the lowermost stirrup 36 thus raising his center of gravity 58 with respect to the waterline 66. He then places his other foot in the next higher stirrup 38. The crew overboard continues to climb the ascension device 4 in this manner while stabilizing his upper body by grasping either the ascension device 4 or the tether 2 above the ascension device attachment apparatus 32. Once the crew has commenced the climbing process, the tether 2 is slack between the ascension device attachment apparatus 32 and the crew attachment device 28. The range of vertical motion is twice the distance between the ascension device attachment apparatus 32 and the crew attachment device 28. For an individual having a height of 2 m, the vertical range of motion will be approximately 2 m provided there are sufficient stirrups 36, 38, 40, 42 and that they are properly spaced. Once the crew overboard has elevated his center of gravity 58 to the level of the gunwale 60, he maneuvers his upper torso over the gunwale 60 or coaming 62, then swings his legs up over the gunwale 60 and reenters the boat.

Figure 8:
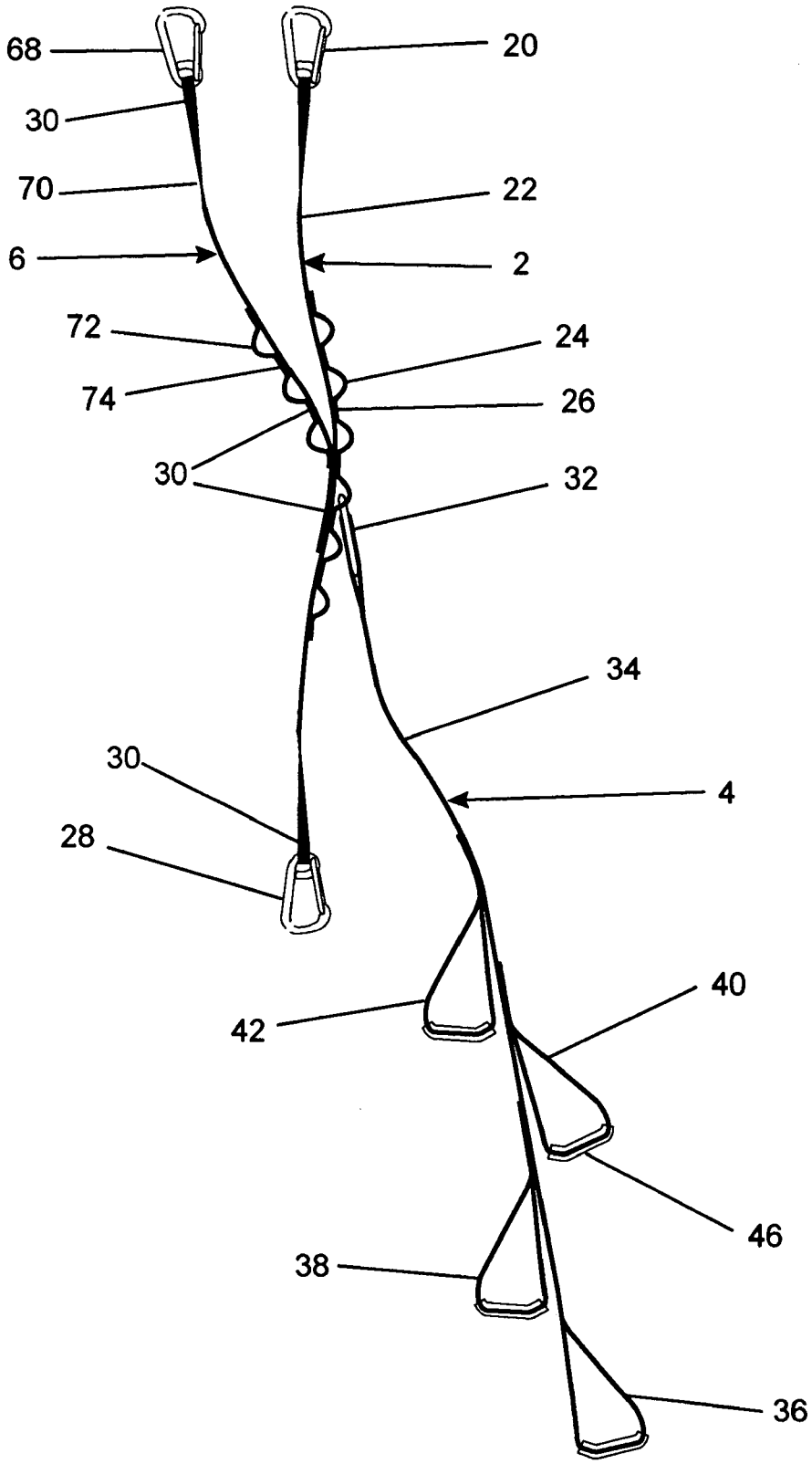
FIG. 8 illustrates the crew overboard self rescue system with a tether, supplemental tether, and an ascension device.
Figure 9:
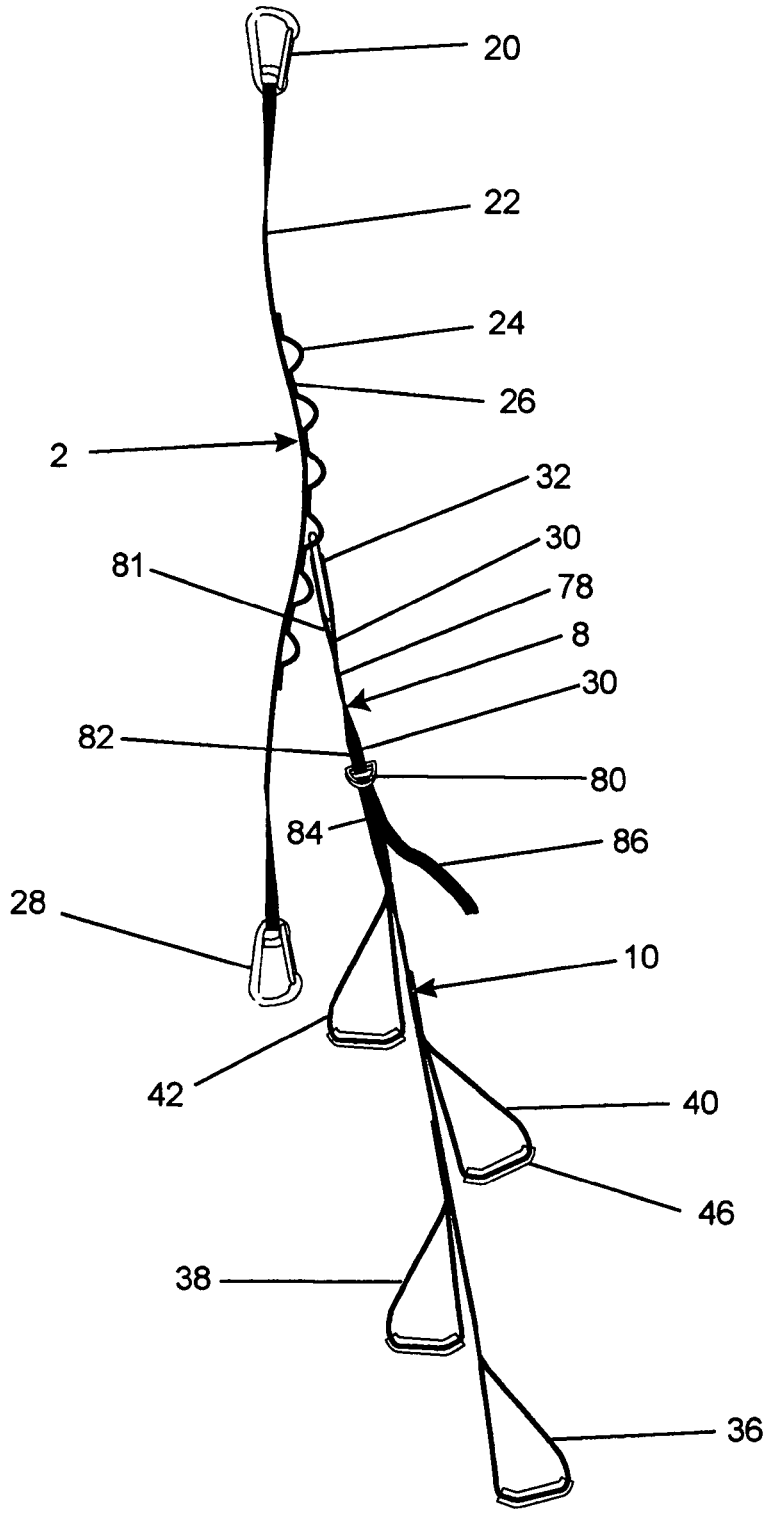
FIG. 9 shows an alternative embodiment of the crew overboard self rescue system in which the length of the ascension device is adjustable.

FIGS. 8, and 9

Additional Embodiments

An additional embodiment is shown in FIG. 8. In this embodiment, a supplemental tether 6 is attached to the tether 2 of the preferred embodiment. The combination of the supplemental tether 6 and the primary tether 2 is referred to as a double tether. The supplemental tether 6 comprises a supplemental watercraft attachment device 68, a supplemental tether strap 70, and supplemental attachment loops 72 formed from a length of supplemental attachment loop webbing 74. In FIG. 8, the supplemental watercraft attachment device 68 is a snap hook. The supplemental tether strap 70 is preferably high strength webbing approximately 2.5 cm in width. The supplemental tether strap 70 is attached to the supplemental watercraft snap hook 68 by passing the supplemental tether strap 70 through the snap hook 68, doubling the supplemental tether strap 70 back onto itself, and securing with stitching of a sufficient length to withstand the shock load imposed by a crew falling overboard. The stitching pattern shown in FIG. 3 and having a length of 14 cm is preferred. Preferably, the thread used for stitching is resistant to degradation by ultraviolet light 30. Supplemental attachment loops 72 are formed by gathering a length of supplemental attachment loop webbing 74 approximately 2.5 cm in width. The supplemental attachment loop webbing 74 preferably is secured to the supplemental tether strap 70 with stitching between the supplemental attachment loops 72. Preferably, the thread used for stitching is resistant to degradation by ultraviolet light 30. The stitching between the supplemental attachment loops 72 is of a sufficient length to support the weight of a crew overboard. The stitching pattern shown in FIG. 2 and having a length of 5 cm is adequate for this purpose. The end of the supplemental tether strap 70 distal to the supplemental watercraft snap hook 68 preferably is attached to the primary tether strap 22 with stitching of sufficient length to withstand the shock load imposed by a crew falling overboard. The thread used for stitching is preferably resistant to degradation by ultraviolet light 30. The stitching pattern shown in FIG. 3 and having a length of 14 cm is preferred. The location of the attachment of the supplemental tether strap 70 to the primary tether strap 22 is chosen to provide the crew with a desired mobility as will become apparent in the following description of operation. However, the distance between the crew attachment device 28 and the supplemental watercraft attachment device 68 should not exceed the length of the primary tether 2.

The advantage of the double tether is that it allows a crew to move about the watercraft while remaining attached to the watercraft at all times. To use the double tether, the crew attaches the watercraft attachment device 20 to a hard point on the watercraft such as a pad eye and the crew attachment device 28 to the crew's harness. To keep the supplemental tether 6 out of the way, the crew may elect to attach the supplemental watercraft attachment device 68 to the pad eye, watercraft attachment device 20, or attachment loop 24. To change the location of attachment of the double tether, the crew attaches the supplemental watercraft attachment device 68 to a hard point on the watercraft disposed distal to the point of attachment of the watercraft attachment device 20, and detaches the watercraft attachment device 20 from its point of attachment. In a crew overboard situation, the ascension device 4 is attached to either the primary tether 2 or the supplemental tether 6 thus supporting the weight of the crew. The ascension device 4 is then utilized as described in the preferred embodiment of the invention.

Referring to FIG. 9, another embodiment is shown in which the length of the ascension device is adjustable. In this embodiment, the ascension device of the preferred embodiment 4 is replaced by a buckle tether 8 and an adjustable ascension device 10. The buckle tether comprises an ascension device attachment apparatus 32, an upper elongate flexible tensile member 78, and a buckle 80. In FIG. 9, the ascension device attachment apparatus 32 is a snap hook located at the uppermost end of the upper elongate flexible tensile member 81. The upper elongate flexible tensile member 78 is preferably webbing approximately 2.5 cm in width and of a sufficient strength to support the weight of a crew overboard. The upper elongate flexible tensile member 78 is attached to the ascension device attachment apparatus 32 by looping the upper elongate flexible tensile member 78 through the ascension device attachment apparatus 32, doubling the upper elongate flexible tensile member 78 back onto itself, and securing with stitching of a sufficient length to support the weight of a crew. Preferably, the thread used for stitching is resistant to degradation by ultraviolet light 30. A stitching pattern having a length of 14 cm as shown in FIG. 3 is adequate for this purpose. The lowermost end of the upper elongate flexible tensile member 82 distal to the buckle tether ascension device attachment apparatus 32 is preferably attached to a buckle 80 by looping the upper elongate flexible tensile member 78 through the buckle 80, doubling the upper elongate flexible tensile member 78 back onto itself, and securing with stitching of a sufficient length to support the weight of a crew. Preferably, the thread used for stitching is resistant to degradation by ultraviolet light 30. Stitching identical to that used to attach the ascension device attachment apparatus 32 to the upper elongate flexible tensile member 78 is preferred. The length of the buckle tether 8 is minimized so as to maximize elevation of the ascension device stirrups 36, 38, 40, 42 with respect to the tether 2. The adjustable ascension device 10 is identical to the ascension device 4 of the preferred embodiment except that the ascension device attachment apparatus 32 of the preferred embodiment is eliminated and the length of the lower elongate flexible tensile member 84 determined so that a crew overboard in the water can access both the lowermost stirrup 36 and the ascension device uppermost bitter end 86.

Prior to use of the adjustable ascension device 10, the ascension device uppermost bitter end 86 is looped through the buckle 80 and the length of the uppermost bitter end 86 adjusted so that a crew can reach both the lowermost stirrup 36 and the ascension device uppermost bitter end 86 while in the water. The adjustable ascension device 10 and buckle tether 8 are then stowed in a storage means 52 attachable to the crew. In a crew overboard situation, the crew retrieves the adjustable ascension device 10 and buckle tether 8 from the storage means 52, attaches the ascension device attachment apparatus 32 to the highest attachment loop 24 he can reach on the tether 2, and adjusts the height of the stirrups 36, 38, 40, 42 by pulling on the ascension device uppermost bitter end 86 to provide maximum elevation while maintaining access to the lowermost stirrup 36. The crew overboard then ascends the adjustable ascension device 10 as he would the ascension device 4 of the preferred embodiment.

Alternative Embodiments

A variety of alternative embodiments are made possible by substitution of components having the same function as those described in detail above. Additional alternative embodiments become evident when one considers the current state of the art in marine tether design.

Figure 10:
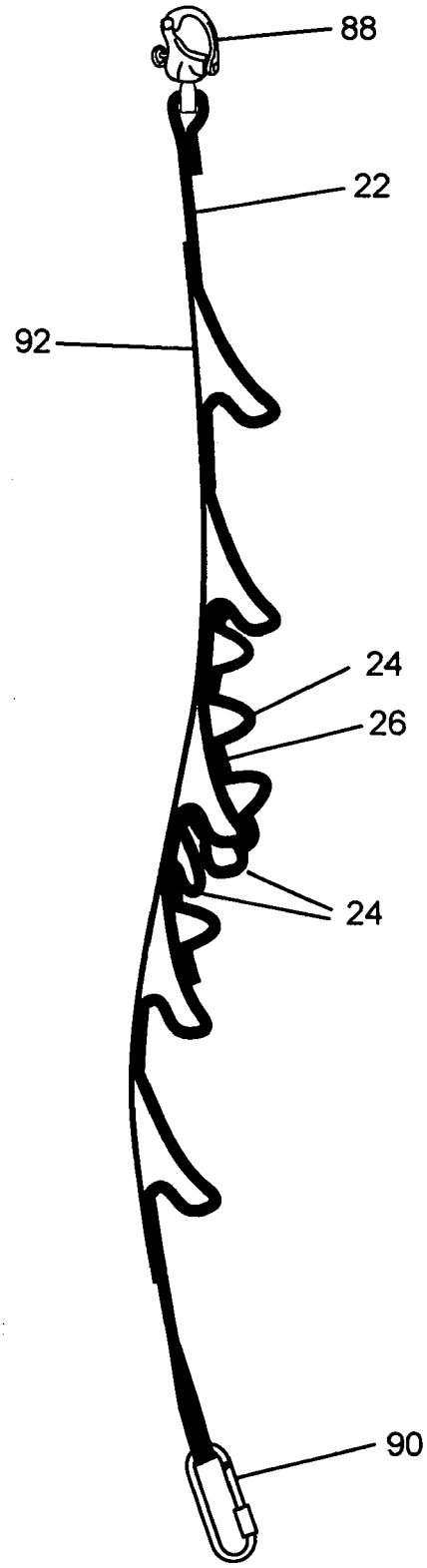
FIG. 10 shows a tether to which a stretched length of elastic material has been attached with the tension in the elastic material relieved.

Numerous existing attachment means can be substituted for the snap hooks 20, 28, 32, 68 terminating the ends of the tether and the ascension device. Two examples shown in FIG. 10 are the snap shackle 88 and the carabiner 90. Proprietary snap hooks and safety hooks having various closure systems are also commercially available. Advantages range from quick release to prevention of accidental release.

One disadvantage associated with the use of tethers is that they can snag on equipment thus impeding movement. To minimize the snagging of either the tether or ascension device, one alternative embodiment employs elastic to shorten the tether or ascension device. As shown in FIG. 9, an extended elastic cord 92 is attached to the tether webbing 22 so that when tension is released from the tether, the effect of the elastic cord is to shorten the tether. Alternatively, the elastic cord may be threaded through the internal cavity of a tether made from tubular webbing and secured at regular intervals with stitching.

Another alternative embodiment involves modification of the stirrup. In this case, the tube serving as a stirrup spreader 46 is replaced by a semi-rigid strip of material sewn onto the stirrup. The semi-rigid strip has enough longitudinal stiffness to maintain the stirrup in an open position.

Another alternative embodiment entails the use of buoyant material for the stirrup spreaders 46.

Figure 11:
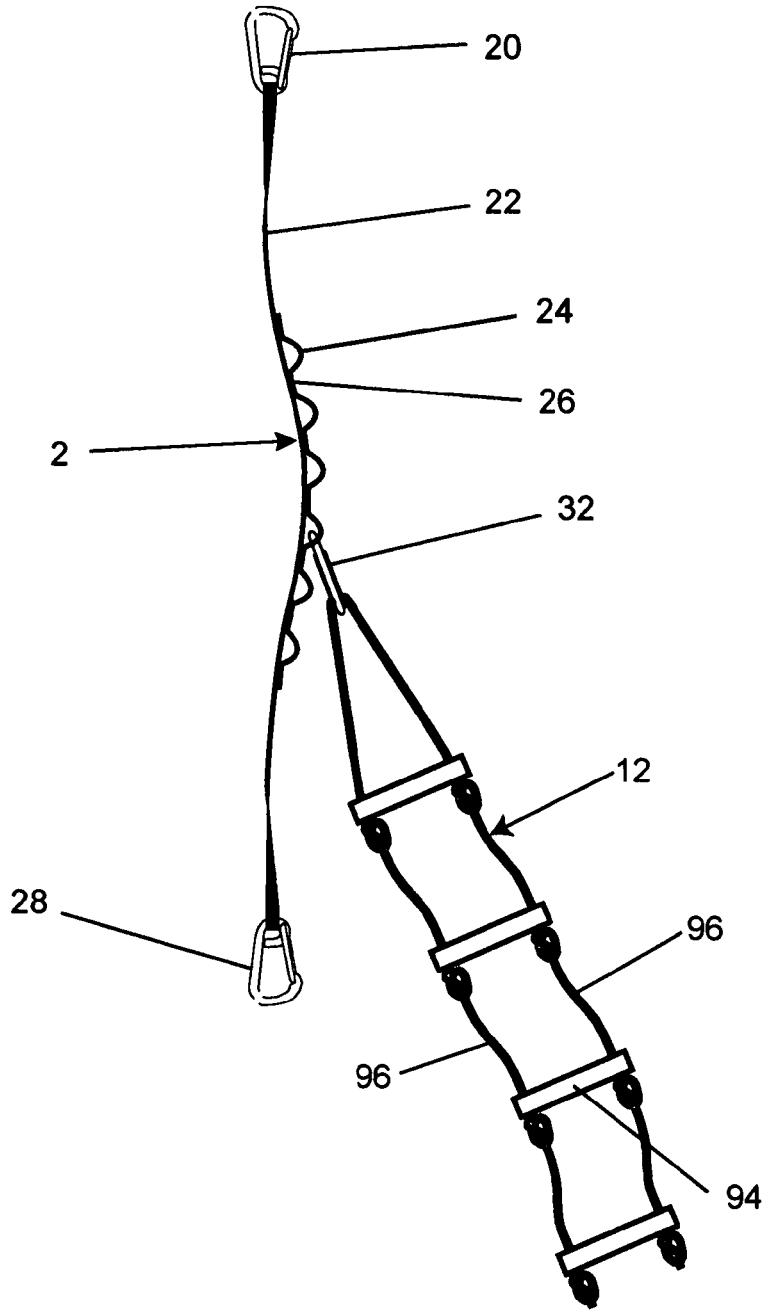
FIG. 11 shows a crew overboard self rescue device in which the ascension device comprises a ladder.

Another alternative embodiment is shown in FIG. 11. In this embodiment, the ascension device comprises a ladder 12 with an ascension device attachment apparatus 32 at its top. The rungs 94 of the ladder may be constructed of either a rigid or flexible material. Examples of suitable flexible materials include webbing or rope. Rigid materials might include molded plastic, reinforced plastic, or wood. The vertical elongate flexible members of the ladder 96 are made from a flexible material such as rope or webbing so that the ladder may be stored compactly upon one's person. In FIG. 11, a single piece of rope is used. Support of rungs 94 is accomplished by knotting the rope below holes in each end of the rungs 94 through which the rope passes. A vertical spacing between rungs of approximately 30 cm is suitable. Distance between the uppermost rung and the ascension device attachment apparatus 32 is approximately 95 cm.

Figure 12:
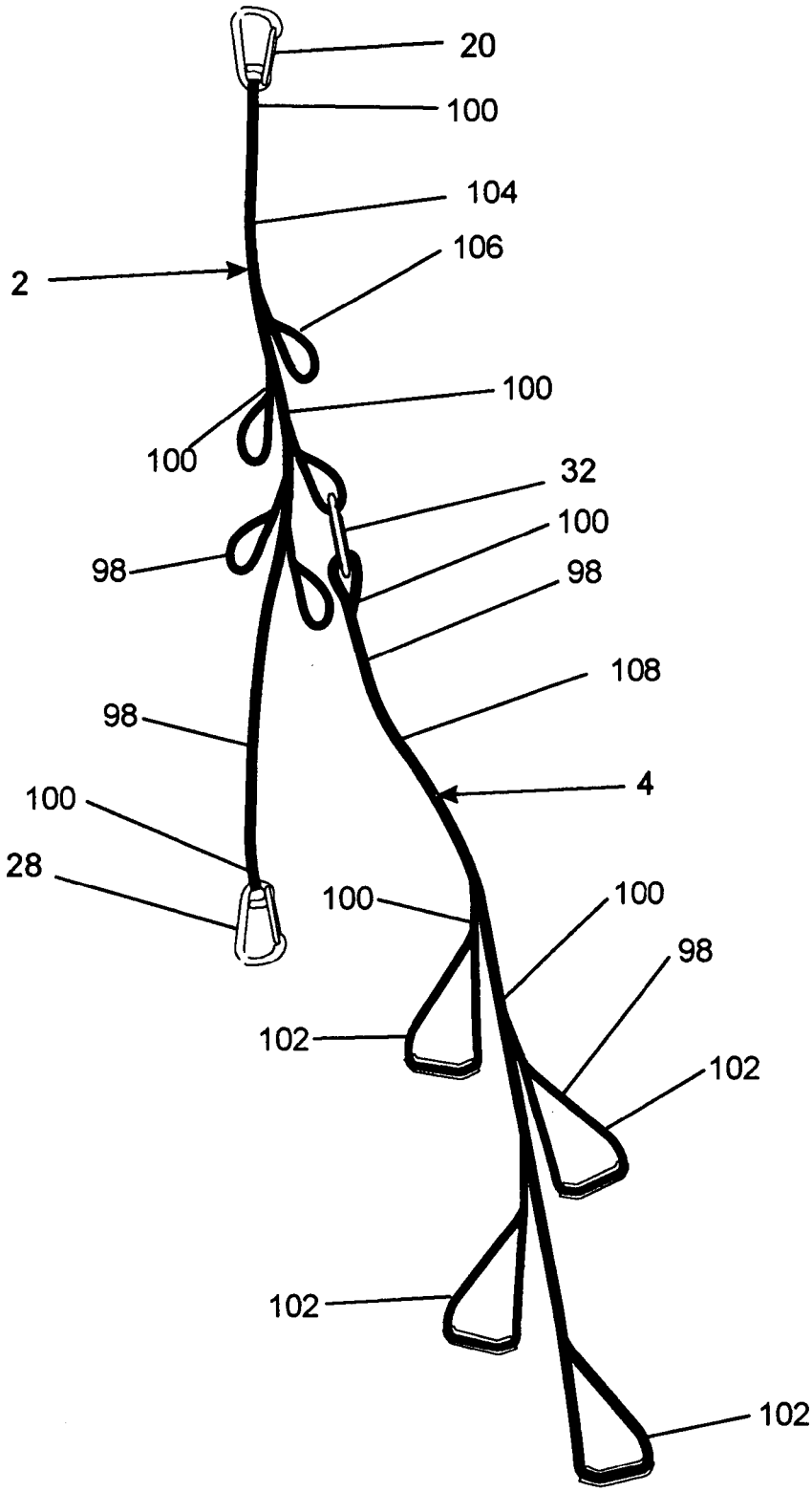
FIG. 12 illustrates a crew overboard self rescue device in which both the tether and ascension device comprise cord.

Yet another embodiment is shown in FIG. 12. In this embodiment, the tether straps 22, 70, the elongate flexible tensile member 34, the attachment loops 24, 72, or the stirrups 36, 38, 40, 42 are replaced with rope or line 98 having an essentially circular cross section. In this embodiment, splices 100 are used to create attachment loops 106 and stirrups 102. Additional splices 100 are then used to join the attachment loops 106 to the tether 104 and the stirrups 102 to the elongate flexible tensile member 108. The lengths of the tether, the elongate flexible tensile member, stirrup perimeters, and spacing, between stirrups are identical to those specified for the preferred embodiment. By replacing stitching with splices, one need not be concerned with degradation of stitching by ultraviolet light. In yet another embodiment, eye splices are supported by thimbles to minimize chafing of ropes or lines with circular cross section.

In an additional embodiment, the tether straps 22, 70, the elongate flexible tensile member 34, attachment loops 24, 72, or stirrups 36, 38, 40, 42 are replaced with cable. In this case, the required loops in the cable are secured with crimped sleeves or wire rope clamps.

The reader will recognize that additional alternative embodiments are possible by varying the distance along the tether straps 22, 70 over which the attachment loops 24, 72 extend, the spacing between attachment loops 24, 72, the number of attachment loops 24, 72, the size of attachment loops 24, 72, the symmetry of the placement of attachment loops 24, 72 along the tether straps 22, 70, or the length of the tether straps 22, 70. Likewise, additional alternative embodiments are possible by varying the distance along the elongate flexible tensile member 34 over which the stirrups 36, 38, 40, 42 extend, the spacing between stirrups 36, 38, 40, 42, the number of stirrups 36, 38, 40, 42, the size of stirrups 36, 38, 40, 42, the symmetry of the placement of stirrups 36, 38, 40, 42 along the elongate flexible tensile member 34, the length of the elongate flexible tensile member 34, or the distance between the ascension device attachment apparatus 32, and the uppermost stirrup 42.

Advantages

From the description above, a number of advantages of my crew overboard self recovery device become evident:

(a) the crew overboard self recovery system provides the means for a crew overboard to ascend to the level of the gunwale and reenter the boat;

(b) the crew overboard does not require assistance from others to reenter the boat;

(c) because leg strength is used to power the crew overboard self recovery system, persons of average strength can use the system effectively;

(d) because the crew overboard self recovery system also functions as a tether, the crew overboard is attached to the boat at all times;

(e) because the crew overboard self recovery system deploys at the location of the crew overboard, there is no need to swim to a remote ladder or trailing line;

(f) the crew overboard self recovery system does not require additional hardware to be mounted on the boat;

(g) because leg strength is used, the crew overboard can overcome the drag on himself resulting from the forward motion of the boat through the water;

(h) all components of the crew overboard self recovery system are worn by the user;

(i) the crew overboard recovery system weighs little more than a standard tether with the result that it is likely to be worn;

(j) the crew overboard self recovery system is easy and inexpensive to manufacture.

CONCLUSION, RAMIFICATIONS, AND SCOPE

Accordingly, the reader will see that the crew overboard self recovery system of this invention can be used by a crew overboard to ascend a freeboard in excess of his reach above the water and to reenter a boat unassisted by others. Furthermore, the crew overboard self recovery system has the additional advantages in that Because of its construction, a person of average strength can use the system;

The crew overboard is attached to the boat at all times;

There is no need to swim to a remote ladder or trailing line;

No additional hardware need be mounted on the boat;

Because the crew overboard is able to overcome drag induced by the relative motion of his body and the water, drownings resulting from drag are minimized;

All components of the system are close at hand because they are worn by the user;

The light weight of the system makes it no more cumbersome than a standard tether;

Manufacture is simple and inexpensive.

Although the description above contains many specificities, these should not be construed as limiting the scope of the invention but as merely providing illustrations of some of the presently preferred embodiments of this invention. For example, webbing can be replaced by rope or cable, rope by webbing or cable, and cable by webbing or rope, etc.

Snap hooks can be replaced by snap shackles and snap shackles by carabiners, etc. Cross sectional geometry of tether or ascension device components, attachment means, etc. may be altered to enhance functional characteristics, aid in manufacturability, or because of availability as in the case of off the shelf items. Anti-chafe devices such as thimbles may be added to improve the reliability of the design, etc.

Thus the scope of the invention should be determined by the appended claims and their legal equivalents, rather than by the examples given.

I claim:

1. A crew overboard self rescue device comprising:

a tether having a watercraft attachment device fixed at a first end of said tether for connecting said tether to a watercraft;

a crew attachment device fixed at a second end of said tether for connecting said tether to a crew;

an ascension device including an ascension attachment apparatus and two or more footholds positioned along said ascension device;

a container wearable by said crew for storing said ascension device;

two or more attachment loops secured to said tether at locations between said watercraft attachment device and said crew attachment device, said attachment loops having a size large enough to permit insertion of said ascension device attachment apparatus to attach said ascension device to said tether;

whereby said crew situated overboard may attach said ascension device to one of said attachment loops enabling said crew to climb said ascension device, hence raising center of gravity of said crew with respect to a waterline of said watercraft, thereby enabling said crew to reenter said watercraft.

2. The crew overboard self rescue device of claim 1 wherein said tether comprises a strap.

3. The crew overboard self rescue device of claim 2 wherein at least a length of attachment loop webbing is secured to said strap by stitching with thread resistant to degradation by ultraviolet light at least two locations disposed along said length of attachment loop webbing to form at least a portion of a closed loop between said at least two locations whereby said at least a portion of a closed loop comprises said at least a portion of said attachment loop.

4. The crew overboard self rescue device of claim 1 wherein said at least one attachment loop comprises flat webbing secured to said tether with stitching.

5. The crew overboard self rescue device according to claim 1, further comprising:

a harness wearable by said crew for receiving said crew attachment device and connecting said tether to said crew.

6. The crew overboard self rescue device of claim 1 wherein at least one of said watercraft attachment device and said crew attachment device comprises a snap hook having a closure system which prevents unintentional detachment from said watercraft or said crew.

7. The crew overboard self rescue device of claim 1 wherein a stretched length of elastic material is attached at a plurality of locations disposed along said tether whereby the length of said tether is decreased when a tensile force extending said elastic material is relaxed.

8. The crew overboard self rescue device of claim 1 wherein at least one of said watercraft attachment device and said crew attachment device comprises a snap shackle wherein said snap shackle comprises means to provide rapid detachment of said tether from said watercraft or said tether from said crew while said tether is under tension.

9. A crew overboard self rescue device comprising:

a tether having a watercraft attachment device fixed at a first end of said tether for connecting said tether to a watercraft;

said tether having a crew attachment device fixed at a second end of said tether for connecting said tether to a crew;

at least one attachment loop secured to said tether at a location between said watercraft attachment device and said crew attachment device, said at least one attachment loop having a size large enough to permit easy insertion of an ascension device attachment apparatus in said at least one attachment loop, yet said at least one attachment loop having said size small enough so that said ascension device attachment apparatus inserted in said at least one attachment loop is situated as close as practically possible to said location at which said at least one attachment loop is secured to said tether, and said attachment loop being disposed on said tether at a distance from said crew attachment device equal to or slightly less than a maximum length said crew can reach from said crew attachment device along said tether;

whereby said crew situated overboard may attach an ascension device to said at least one attachment loop enabling said crew to climb said ascension device, hence raising center of gravity of said crew with respect to a waterline of said watercraft, thereby enabling said crew to reenter said watercraft;

wherein a supplemental tether having a supplemental watercraft attachment device disposed on its free end and having at least one supplemental attachment loop disposed along its length is disposed on said tether whereby said crew may attach said crew attachment device to said crew, and alternately attach and detach said watercraft attachment device and said supplemental watercraft attachment device to and from said watercraft; and whereby said crew may remain tethered to said watercraft at all times while changing location on said watercraft.

10. A crew overboard self rescue device comprising:

a tether having a watercraft attachment device fixed at a first end of said tether for connecting said tether to a watercraft;

a crew attachment device fixed at a second end of said tether for connecting said tether to a crew;

at least one attachment loop secured to said tether at a location between said watercraft attachment device and said crew attachment device, said attachment loop being disposed on said tether at a distance from said crew attachment device that said crew can reach from said crew attachment device along said tether;

an ascension device comprising an array of footholds vertically disposed at fixed locations along at least one elongate flexible tensile member, said array of footholds extending from a first location proximal to a bottom of said at least one elongate flexible tensile member and said ascension device having at least one ascension device attachment apparatus positioned superior to said array of footholds and in tensile communication with said at least one elongate flexible tensile member;

whereby said crew situated overboard may attach said ascension device to said at least one attachment loop enabling said crew to climb said ascension device, hence raising center of gravity of said crew with respect to a waterline of said watercraft, thereby enabling said crew to reenter said watercraft; and wherein said at least one attachment loop has a size large enough to permit insertion of the ascension device attachment apparatus to attach said ascension device to said tether.

11. The crew overboard self rescue device of claim 10 wherein said ascension device comprises a ladder.

12. The crew overboard self rescue device of claim 10 wherein at least one of said footholds comprises a stirrup.

13. The crew overboard self rescue device of claim 12 wherein at least one spreader is disposed on at least one said stirrup whereby said stirrup is maintained in an open configuration to facilitate insertion of a foot of said crew.

14. The crew overboard self rescue device of claim 12 wherein said stirrup comprises a strap.

15. The crew overboard self rescue device of claim 14 wherein said stirrup is attached to said strap by sewing with thread resistant to degradation by ultraviolet light.

16. The crew overboard self rescue device of claim 12 wherein said at least one elongate flexible tensile member comprises a cord and said stirrup comprises a cord.

17. The crew overboard self rescue device of claim 10 wherein said ascension device comprises buoyant material whereby said ascension device floats thereby precluding entanglement in a propeller of said watercraft.

18. A crew overboard self rescue device comprising:

a tether having a watercraft attachment device fixed at a first end of said tether for connecting said tether to a watercraft;

said tether having a crew attachment device fixed at a second end of said tether for connecting said tether to a crew;

at least one attachment loop secured to said tether at a location between said watercraft attachment device and said crew attachment device, said at least one attachment loop having a size large enough to permit easy insertion of an ascension device attachment apparatus in said at least one attachment loop, yet said at least one attachment loop having said size small enough so that said ascension device attachment apparatus inserted in said at least one attachment loop is situated as close as practically possible to said location at which said at least one attachment loop is secured to said tether, and said attachment loop being disposed on said tether at a distance from said crew attachment device equal to or slightly less than a maximum length said crew can reach from said crew attachment device along said tether;

an ascension device comprising an array of footholds vertically disposed at fixed locations along at least one elongate flexible tensile member, said array of footholds extending from a first location proximal to a bottom of said at least one elongate flexible tensile member and said ascension device having at least one ascension device attachment apparatus positioned superior to said array of footholds and in tensile communication with said at least one elongate flexible tensile member;

whereby said crew situated overboard may attach said ascension device to said at least one attachment loop enabling said crew to climb said ascension device, hence raising center of gravity of said crew with respect to a waterline of said watercraft, thereby enabling said crew to reenter said watercraft;

wherein said ascension device further comprises (a) an upper elongate flexible tensile member, said upper elongate flexible tensile member comprising said ascension device attachment apparatus disposed at an uppermost end of said upper elongate flexible tensile member and a buckle disposed at a lowermost end of said upper elongate flexible tensile member, and (b) a lower elongate flexible tensile member, said lower elongate flexible tensile member comprising said array of footholds and an uppermost bitter end; and whereby said uppermost bitter end of said lower elongate flexible tensile member slideably engages said buckle disposed at said lowermost end of said upper elongate flexible tensile member, thereby allowing adjustment of the distance between said array of footholds and said buckle.

19. A method for a crew overboard to reenter a watercraft without assistance from another person comprising the steps of:

removing an ascension device from a container worn by the crew overboard, the ascension device including two or more footholds;

attaching the ascension device to an attachment loop disposed on a tether between a watercraft attachment device of said tether attached to a watercraft and a crew attachment device of said tether attached to said crew overboard;

maintaining said crew overboard in an upright position by grasping said tether with at least one hand of said crew overboard;

engaging a first foot with a foothold fixed to said ascension device, transferring weight of said crew overboard to said first foot, extending a first leg attached to said first foot, thereby elevating a center of gravity of said crew overboard;

engaging a second foot with a next successively higher foothold fixed to said ascension device, transferring said weight of said crew overboard to said second foot, disengaging said first foot, extending a second leg attached to said second foot, thereby further elevating said center of gravity of said crew overboard; and moving said center of gravity of said crew overboard horizontally towards a center of said watercraft whereby said crew overboard reenters said watercraft.

20. A crew overboard self rescue device comprising:

a tether having a watercraft attachment device fixed at a first end of said tether for attaching said tether to a watercraft;

a crew attachment device fixed at a second end of said tether for attaching said tether to a person to tether the person to the watercraft;

two or more attachment points on said tether between said watercraft attachment device and said crew attachment device; and an ascension device including two or more footholds positioned along said ascension device and an ascension attachment apparatus for attaching said ascension device to said tether via one of said attachment points;

wherein said ascension device further includes an upper elongate flexible tensile member, said upper elongate flexible tensile member comprising said ascension device attachment apparatus disposed at an uppermost end of said upper elongate flexible tensile member and a buckle disposed at a lowermost end of said upper elongate flexible tensile member, and a lower elongate flexible tensile member, said lower elongate flexible tensile member comprising said two or more footholds; and wherein said lower elongate flexible tensile member slideably engages said buckle disposed at said lowermost end of said upper elongate flexible tensile member allowing adjustment of a distance between said two or more footholds and said buckle.

21. The crew overboard self rescue device according to claim 20, further comprising:

a container accessible by said person for storing said ascension device.

22. The crew overboard self rescue device according to claim 20, further comprising:

a harness wearable by the person for receiving said crew attachment device and connecting said tether to the person.

* * * * *